US008029274B2

(12) United States Patent
Jones et al.

(10) Patent No.: US 8,029,274 B2
(45) Date of Patent: Oct. 4, 2011

(54) CONVECTION OVEN WITH LAMINAR AIRFLOW AND METHOD

(75) Inventors: Douglas S. Jones, New Port Richey, FL (US); William J. Day, Jr., New Port Richey, FL (US); Malcolm Reay, Drums, PA (US); Ryan J. Stephens, Dallas, PA (US)

(73) Assignee: Garland Commercial Industries, LLC, Freeland, PA (US)

( * ) Notice: Subject to any disclaimer, the term of this patent is extended or adjusted under 35 U.S.C. 154(b) by 246 days.

(21) Appl. No.: 11/700,280

(22) Filed: Jan. 31, 2007

(65) Prior Publication Data

US 2007/0125319 A1 Jun. 7, 2007

Related U.S. Application Data

(63) Continuation of application No. 10/401,136, filed on Mar. 27, 2003, now Pat. No. 7,192,272.

(60) Provisional application No. 60/367,970, filed on Mar. 27, 2002, provisional application No. 60/382,061, filed on May 21, 2002, provisional application No. 60/406,946, filed on Aug. 29, 2002.

(51) Int. Cl.
*F27B 5/16* (2006.01)

(52) U.S. Cl. ..... 432/200; 432/189; 432/203; 126/21 A; 219/401

(58) Field of Classification Search ..... 432/200, 432/201–203.189; 219/400, 681, 401; 126/19 R, 126/20, 20.1, 21 A; 416/95, 96 R, 97 A, 416/186 R, 235, 238; 99/473, 474, 476
See application file for complete search history.

(56) References Cited

U.S. PATENT DOCUMENTS

| | | | | |
|---|---|---|---|---|
| 3,991,737 | A * | 11/1976 | Del Fabbro | 126/21 A |
| 4,587,946 | A | 5/1986 | Doyon et al. | 126/20 |
| 4,648,377 | A | 3/1987 | Van Camp | 126/21 A |
| 4,700,685 | A | 10/1987 | Miller | 126/20 |
| 4,771,163 | A | 9/1988 | Thiboutot | 219/400 |
| 4,813,398 | A | 3/1989 | Savage | 126/21 A |
| 4,928,663 | A | 5/1990 | Nevin et al. | 126/21 A |
| 5,222,474 | A | 6/1993 | Yencha, III | 126/21 A |
| 5,361,749 | A | 11/1994 | Smith et al. | 126/21 A |
| 5,499,577 | A | 3/1996 | Tommasini | 99/476 |
| 5,517,980 | A | 5/1996 | Cappello et al. | 126/20 |
| 5,601,070 | A | 2/1997 | Hotard et al. | 126/21 A |
| 5,707,209 | A | 1/1998 | Iyer et al. | 416/186 R |
| 5,741,118 | A | 4/1998 | Shinbara et al. | 416/186 R |
| 5,768,982 | A | 6/1998 | Violi et al. | 99/476 |
| 5,802,963 | A | 9/1998 | Cohn et al. | 99/476 |
| 5,865,108 | A | 2/1999 | Montagnino et al. | 99/476 |
| 6,042,335 | A | 3/2000 | Amr | 415/208.1 |
| 6,188,045 | B1 | 2/2001 | Hansen et al. | 219/401 |
| 6,192,877 | B1 | 2/2001 | Moshonas et al. | 126/21 A |
| 6,318,246 | B2 | 11/2001 | Fukushima et al. | 99/330 |
| 6,399,930 | B2 | 6/2002 | Day et al. | 219/681 |
| 6,555,791 | B2 * | 4/2003 | Lubrina et al. | 219/400 |
| 6,634,855 | B1 | 10/2003 | Rollo | 415/206 |
| 6,755,615 | B2 | 6/2004 | Chapman | 415/206 |
| 6,904,903 | B1 | 6/2005 | Vroom | 126/20 |

* cited by examiner

*Primary Examiner* — Gregory A Wilson
(74) *Attorney, Agent, or Firm* — Ohlandt, Greeley, Ruggiero & Perle, L.L.P.

(57) ABSTRACT

A convection oven with laminar airflow and/or moisture injection. A radial airflow fan is used to provide a circulating airflow that is substantially even and substantially turbulence free. The circulating airflow is provided to an oven chamber via a plurality of egress ports that rim a divider wall disposed between the oven chamber and a fan chamber. The airflow interleaves with a plurality of pans in the oven chamber to provide a laminar airflow. Moisture is injected into the circulating airflow either upstream of the fan or by flashing water onto the hot blades of the fan from either the low pressure side or the high pressure side of the fan.

6 Claims, 7 Drawing Sheets

CONVECTION OVEN WITH LAMINAR AIRFLOW AND METHOD

This application is a continuation of U.S. application Ser. No. 10/401,136, filed on Mar. 27, 2003 now U.S. Pat. No. 7,192,272, that claims the benefit of U.S. Provisional Application Ser. No. 60/367,970, filed on Mar. 27, 2002, U.S. Provisional Application Ser. No. 60/382,061, filed on May 21, 2002 and U.S. Provisional Application Ser. No. 60/406,946, filed on Aug. 29, 2002, the entire contents of which are incorporated herein.

FIELD OF THE INVENTION

This invention relates to a convection oven and method and, in particular, to a convection oven and method for providing a homogeneous and substantially turbulence free laminar airflow within the oven chamber.

BACKGROUND OF THE INVENTION

Traditional convection ovens use a fan to circulate a heated airflow between a fan chamber and an oven chamber. It is known to introduce steam into the circulating airflow downstream of the fan, as shown, for example, in U.S. Pat. Nos. 4,587,946, 4,771,163 and 6,318,246. U.S. Pat. No. 4,771,163 describes a baking oven that injects steam produced by a steam generator adjacent an ingress port through which the airflow enters the oven chamber. The steam generator is shown as an independent unit that provides the steam. Such steam generators are costly and bulky.

U.S. Pat. No. 4,587,946 eliminates a need for a costly steam generator by providing a plurality of metallic plates upon which water is dripped to produce steam, which is inserted into the circulating airflow downstream of the fan.

U.S. Pat. No. 6,318,246 describes a steam generating mechanism for a convection oven. The mechanism comprises a water tube and fan guard disposed at a suction end of the fan. Water is injected into the suction side of the fan and then converted into steam by contact with an electric heater coil disposed about the periphery of the fan blades.

U.S. Pat. No. 6,339,930 describes a convection oven having a laminar airflow in the oven chamber to more efficiently deliver heated convection air above, below and along the sides of a food product. The circulating airflow enters the oven chamber via ingress ports disposed in the four corners of a divider wall and returns along the center of the oven chamber toward a suction port to the fan.

Fans used in convection ovens typically produce a tangential airflow at the high pressure output thereof. The tangential airflow is fraught with turbulence so that it is difficult to obtain an even air pressure in the fan chamber. The turbulent airflow continues through the ingress port to the oven chamber, thereby leading to uneven heating and uneven cooking.

U.S. Pat. No. 4,771,163 also describes a fan having an air diffusing ring about its periphery. The air diffuser ring has a width about equal to the width of the fan chamber with perforations that are shaped and distributed to allow an essentially even flow through the ingress port to the oven chamber, the ingress port surrounding the divider wall between the fan and oven chambers. The air diffuser ring is difficult to make, requires a large footprint within the fan chamber and is a separate unit, thereby adding cost to the convection oven.

Thus, there is a need to provide an improved convection oven with laminar airflow that has a substantially turbulent free airflow.

There is also a need to provide an improved convection oven with moisture that is converted to steam efficiently and at low cost.

There is also a need for an improved fan that produces a radial airflow.

SUMMARY OF THE INVENTION

A convection oven according to a first embodiment of the present invention comprises a fan chamber, an oven chamber, an egress port and one or more ingress ports that provide fluid communication between the fan chamber and the oven chamber. A fan is disposed in the fan chamber to circulate an airflow in the fan chamber and the oven chamber via the egress port and the ingress ports. The fan comprises a plurality of blades shaped to provide a substantially radial airflow at a high pressure side of the fan that results in a substantially uniform and substantially turbulence free airflow in the fan chamber and the oven chamber.

In a second embodiment of the present invention, the ingress ports are distributed about the egress port at locations that cause the airflow to be laminar about one or more pans disposed on a rack in the oven chamber. The locations are preferably evenly distributed so as to provide airflow along a top, a bottom and a pair of oppositely disposed sides of the oven chamber. The egress port and the ingress ports are preferably disposed in a divider wall that is disposed between the fan chamber and the oven chamber. A plurality of baffle fins is disposed about the periphery of the divider wall and spaced apart from one another to form the ingress ports. The egress port is preferably located substantially centrally of the divider wall in registry with the fan.

In either the first or second embodiment of the present invention, preferably, each fan blade is flat and disposed between first and second rings that are disposed about a hub. Each blade preferably has a taper such that the radial airflow is substantially even across the periphery of the fan between the first and second rings. The taper preferably extends inwardly toward the hub.

In either of the first and second embodiments, a moisture delivery device may be provided to inject moisture into the circulating airflow.

In a third embodiment of the present invention, a convection oven comprises a fan chamber, an oven chamber and a fan that provides an airflow that circulates through the fan chamber and the oven chamber. A hot plate is disposed upstream of the fan. A moisture delivery device is disposed to provide water to the hot plate to flash steam into a suction input of the fan, thereby providing a moisture laden airflow at an output of the fan.

In a fourth embodiment of the present invention, the hot plate has an egress port disposed in registry with the fan and an inlet ring that surrounds the egress port. Water is provided to the hot plate, carried around the inlet ring and converted to steam that enters the airflow upstream of the fan.

In a fifth embodiment of the present invention, a heater is disposed to heat the airflow and the hot plate upstream of the fan. Preferably, the heater is a gas heater. The water is preferably provided to a surface of the hot plate that faces the fan and, preferably, at an angle to the hot plate.

In a sixth embodiment of the present invention, the convection oven of the third embodiment is provided with an egress port and one or more ingress ports disposed and shaped to provide a laminar airflow in the oven chamber.

In a seventh embodiment of the present invention, the fan of the third embodiment comprises a plurality of blades shaped to provide a substantially radial airflow at a high pressure side of the fan. This results in a substantially uniform and substantially turbulence free airflow in the fan chamber and the oven chamber.

In any of the third through seventh embodiments, the hot plate preferably comprises a fan cover for the fan.

In an eighth embodiment of the present invention, a convection oven comprises a fan chamber, an oven chamber and a fan that provides an airflow that circulates through the fan chamber and the oven chamber. A moisture delivery device is disposed to provide water to the fan to inject moisture into the airflow. The moisture delivery device preferably injects the water on one or more blades of the fan from a position adjacent either a suction input or a high pressure output of the fan.

In a ninth embodiment of the present invention, a method provides steam to a circulating and heated airflow in a convection oven by injecting steam into the airflow upstream of a fan that provides the circulating airflow.

In a tenth embodiment of the present invention, the method provides the steam by flashing water on a hot plate disposed near a suction input of the fan. Preferably, the water is flashed at an angle to a surface of the hot plate.

In an eleventh embodiment of the present invention, a method provides steam to a circulating heated airflow in a convection oven by flashing water onto a plurality of blades of a fan that provides the circulating airflow, thereby injecting steam into the circulating airflow. The water is flashed on the blades via either a suction input or a high pressure output of the fan.

In a twelfth embodiment of the present invention, a fan comprises first and second rings disposed about a hub. A plurality of blades are so disposed between the first and second rings and so shaped that a substantially radial airflow is provided when the fan is rotated.

Preferably, each of the blades is flat and aligned radially of the hub. Each blade preferably has a taper such that the radial airflow is substantially homogeneous across the periphery of the fan between the first and second rings. The taper preferably extends toward the hub.

BRIEF DESCRIPTION OF THE DRAWINGS

Other and further objects, advantages and features of the present invention will be understood by reference to the following specification in conjunction with the accompanying drawings, in which like reference characters denote like elements of structure and.

DESCRIPTION OF THE PREFERRED EMBODIMENT

Figure 1:
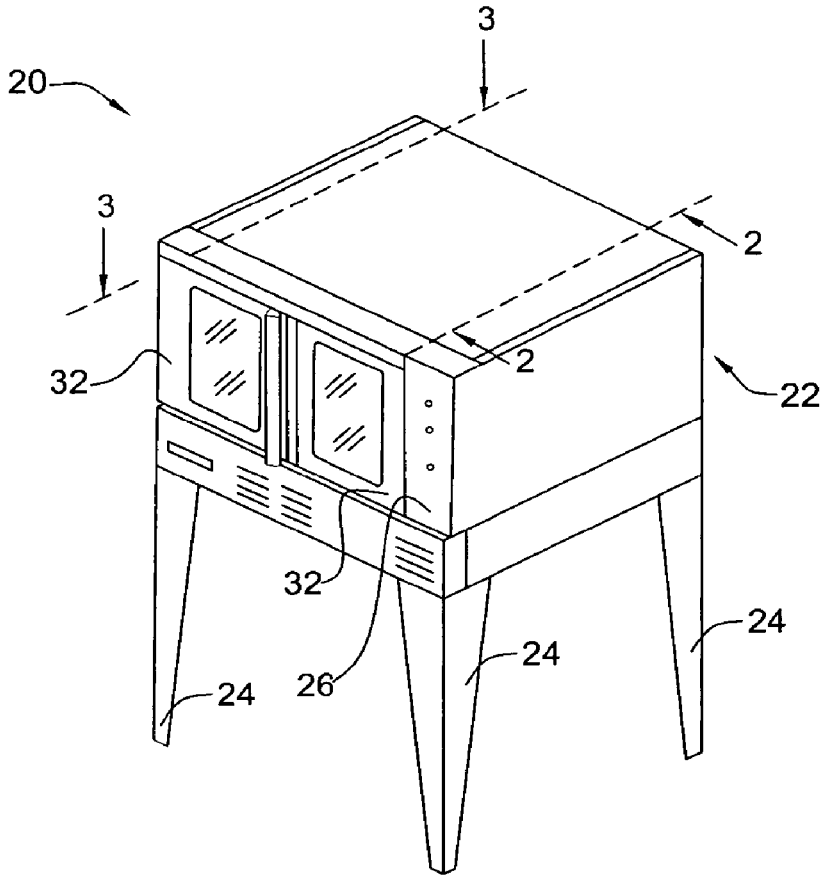
FIG. 1 is a perspective view of the convection oven according to the present invention.
Figure 2:
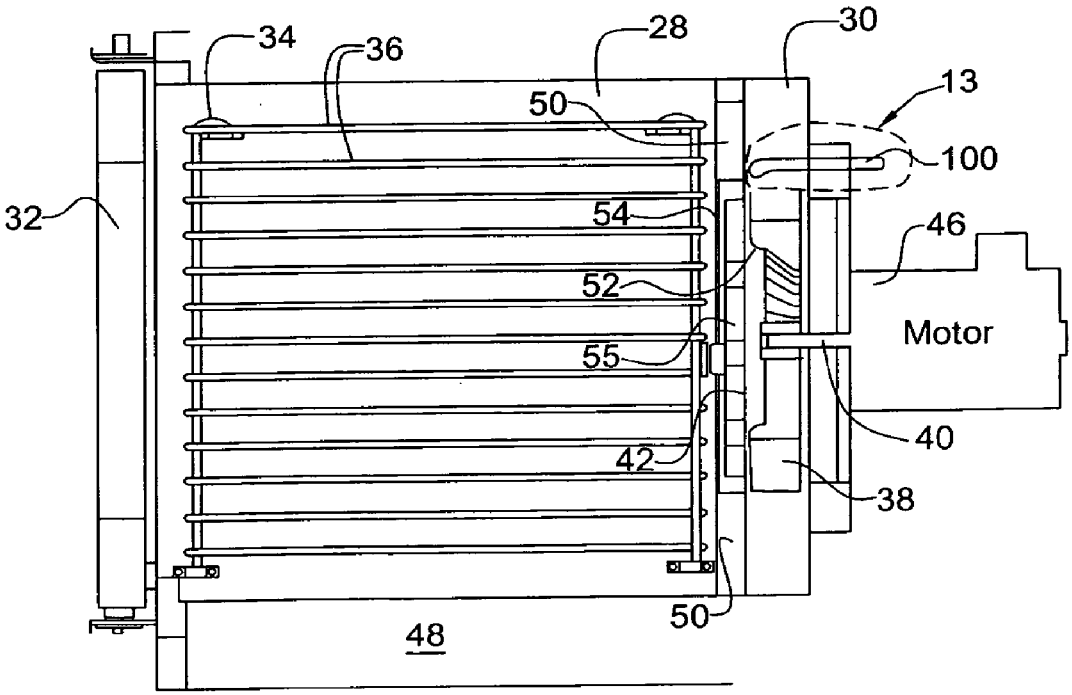
FIG. 2 is a cross-sectional view taken along the line 2 of FIG. 1.
Figure 3:
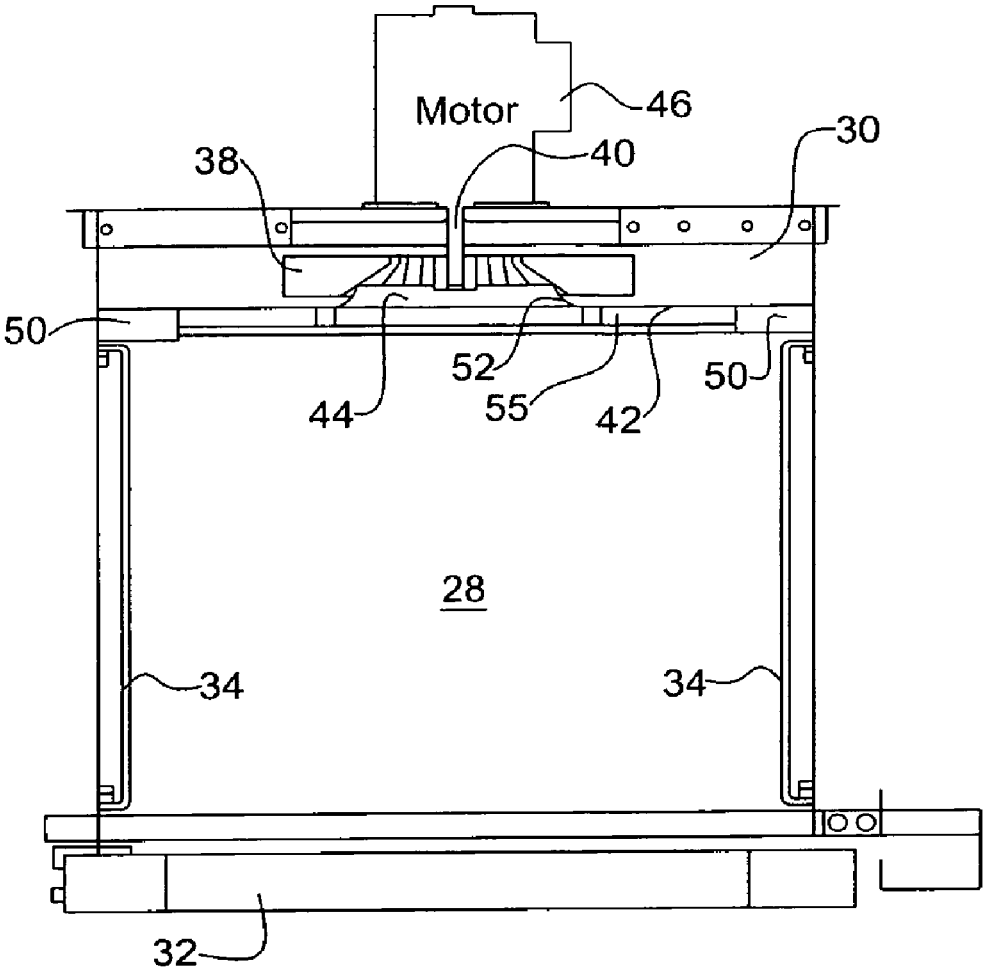
FIG. 3 is a cross-sectional view taken along the line 3 of FIG. 1.

Referring to FIGS. 1-3, a convection oven 20 according to the present invention, includes a cooking oven 22 that is supported by legs 24. Cooking oven 22 has a control section 26 (FIG. 1), an oven chamber 28 and a fan chamber 30 (FIGS. 2 and 3). A pair of doors 32 provides access to oven chamber 28. Control section 26 includes the electrical controls that turn convection oven 20 on and off and that control oven operations, such as cooking, cleaning and the like. It will be apparent to those skilled in the art that convection oven 20, as shown, is a stand alone configuration with double doors, but may have only a single door and/or be configured as a counter top oven.

Referring to FIGS. 2 and 3, oven chamber 28 includes a rack holder 34 capable of holding one or more racks 36. A fan 38 is disposed in fan chamber 30. A divider wall 42 separates oven chamber 28 from fan chamber 30. Divider wall 42 includes an egress port 44. Port 44 is an egress port with respect to airflow exiting oven chamber 28 and is an intake or suction port with respect to fan chamber 30. Fan 38 is disposed in registry with egress port 44. A motor 46 is located adjacent fan chamber 30 and has a shaft 40 that drives and supports fan 38.

A heater 48 (FIG. 2), for example, a gas burner, is disposed below oven chamber 28 and has duct work (not shown) through which combustion products are channeled to a pair of draw tubes 50 located at either side edge of divider wall 42. Draw tubes 50 provide the combustion products to egress port 44 for mixture with intake air from oven chamber 28.

Referring to FIGS. 2-5, divider wall 42 includes an inlet ring 52 that is shaped to aid fan 38 to pull in or take in air from oven chamber 28. A fan cover 54 is disposed on a surface 56 of divider wall 42 that faces oven chamber 28. An opposite surface 58 of divider wall 42 faces fan chamber 30. Fan cover 54 includes an intake port 60, which is in registry with egress port 44 of divider wall 42. Divider wall 42 and fan cover 54 may be constructed of separate pieces or, alternatively, may be a one-piece structure.

Figure 5:
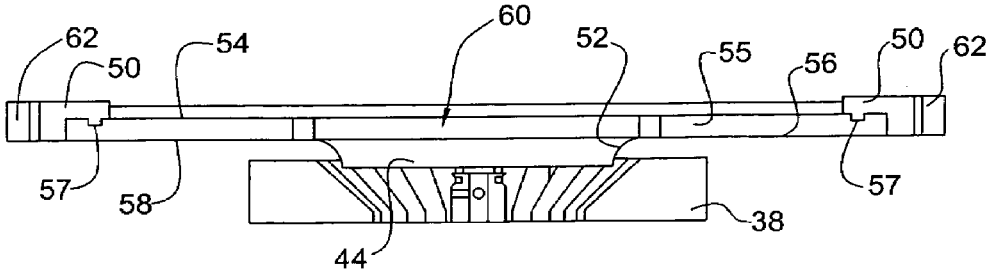
FIG. 5 is a cross-sectional view taken along line 5 of FIG. 4.

Fan cover 54 forms a void 55 between fan cover 54 and surface 56 of divider wall 42 (best seen in FIG. 5). Draw tubes 50 are each in fluid communication with void 55 via ports 57. Fan 38 draws the combustion products from draw tubes 50 via ports 57 through void 55 to egress port 44.

Divider wall 42 includes a plurality of fins 62 arranged about the entire periphery thereof to define a plurality of baffle or ingress ports 64 for airflow into chamber 28. Fins 62 have smooth sides so as to straighten the airflow from fan chamber 30 to oven chamber 28. Ingress ports 64 are shaped and spaced from one another so as to provide a uniform airflow entering oven chamber 28 about the periphery of divider wall 42. For example, ingress ports 64 have a uniform spacing and are square or rectangular in cross-section. It will be apparent to those skilled in the art that other cross-section shapes may be used.

Fan 38 is operable to circulate an airflow in a path that includes egress port 44, fan chamber 30, ingress ports 64 and oven chamber 28. Heater 48 heats the airflow upstream of fan 38.

Figure 6:
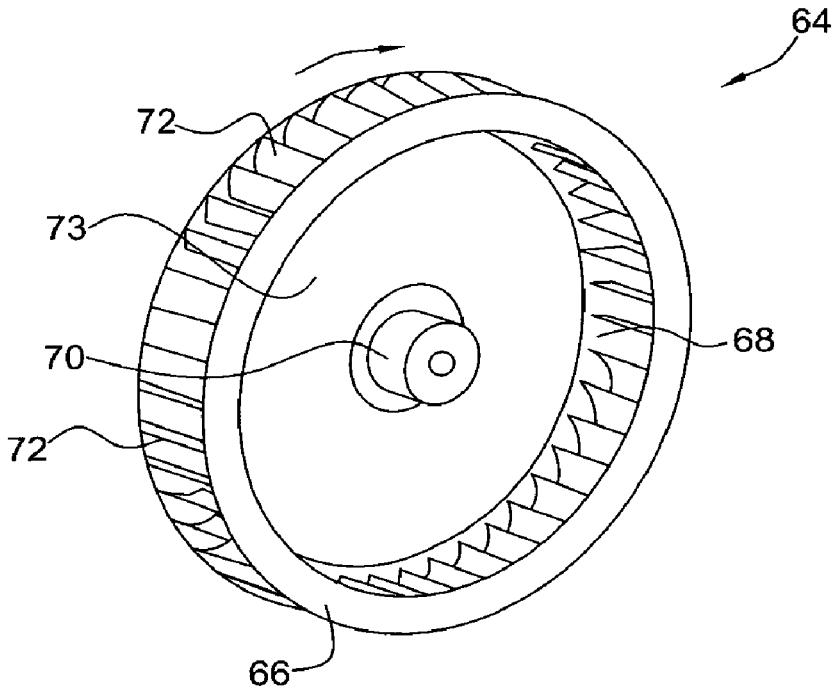
FIG. 6 (Prior Art)
FIG. 6 is a perspective view of a prior art fan.
Figure 7:
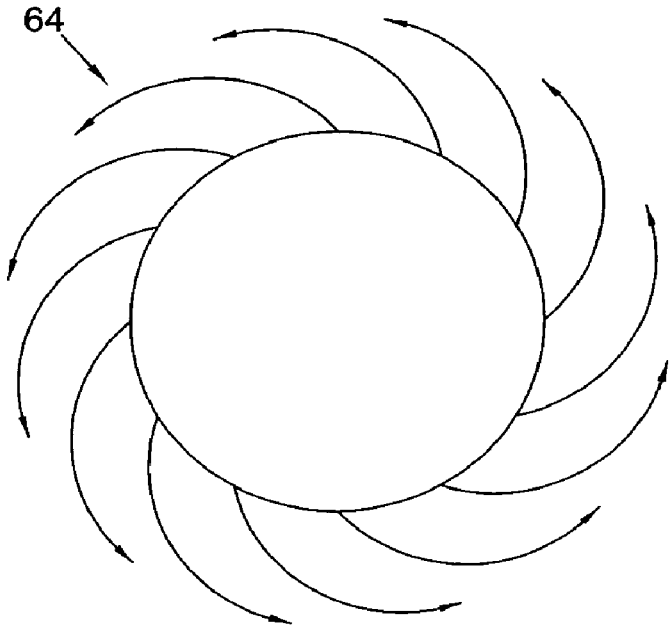
FIG. 7 (Prior Art)
FIG. 7 is a front view of the prior art fan of FIG. 6.

Referring to FIGS. 6 and 7, a prior art fan 64 includes a pair of spaced apart rings 66 and 68 with a plurality of blades 72 disposed therebetween. Rings 66 and 68 are disposed about a hub 70 with a solid support structure 73 that is connected to hub 70 and ring 68. Blades 72 are curved in the direction of rotation of prior art fan 64, i.e., clockwise in FIGS. 6 and 7. As shown in FIG. 7, this results in a tangential swirling airflow at the high pressure side of prior art fan 64 that has a higher pressure at ring 68 than at ring 66. This results in an uneven and turbulent airflow in a fan chamber and an oven chamber, thereby resulting in uneven cooking.

Figure 8:
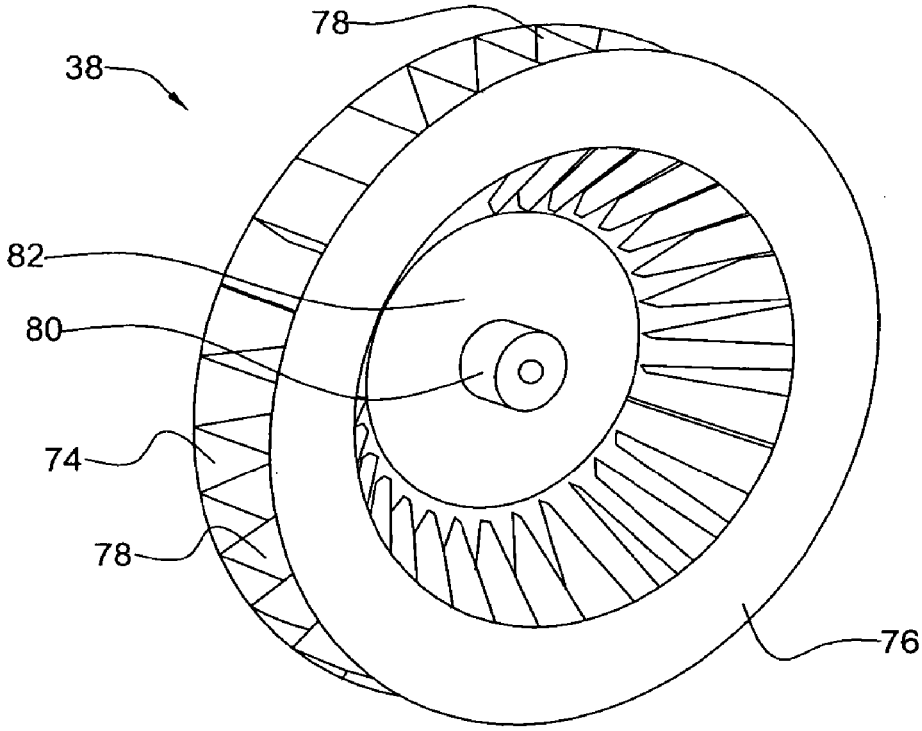
FIG. 8 is a perspective view of the fan of the convection oven of the present invention.
Figure 9:
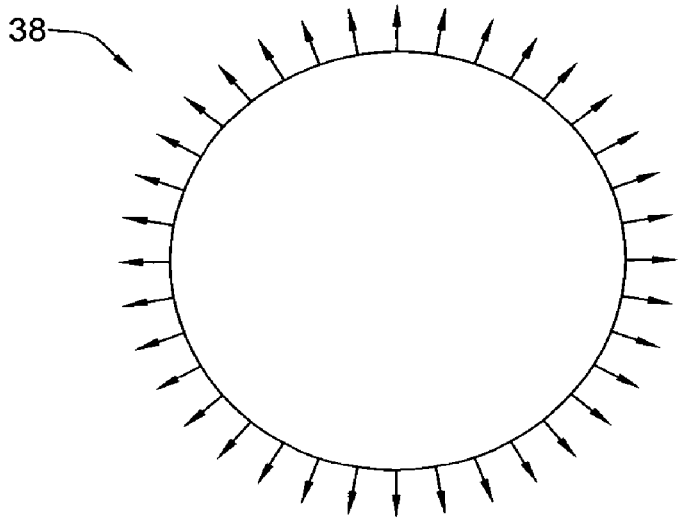
FIG. 9 is a front view of the fan of FIG. 8.

Referring to FIGS. 8 and 9, fan 38 of the present invention includes a pair of spaced apart rings 74 and 76 with a plurality of blades 78 disposed therebetween. Rings 74 and 76 are disposed about a hub 80 with a solid support structure 82 that is connected to hub 80 and ring 74. As shown in FIGS. 1-3 and 5, blades 78 face egress port 44 when fan 38 is installed in convection oven 20.

Figure 10:
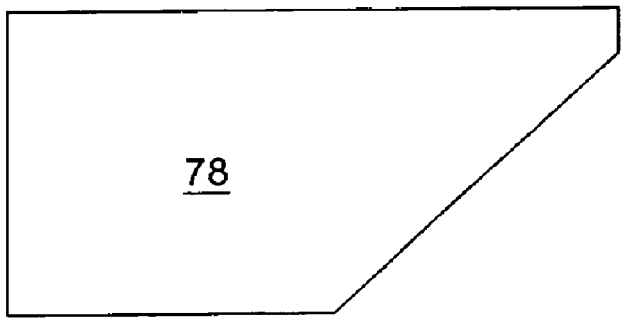
FIG. 10 is a plan view of a blade of the fan of FIG. 8.
Figure 4:
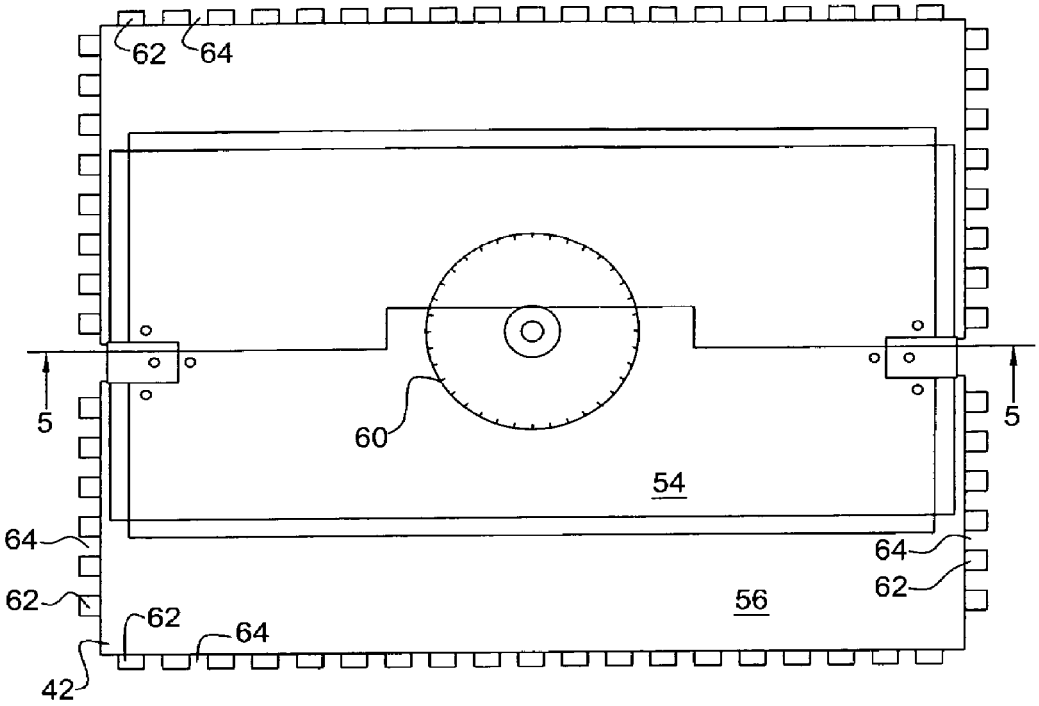
FIG. 4 is a front view of the divider wall and fan cover of the convection oven of FIG. 1.

Referring to FIGS. 8-10, blades 78 are flat or straight in the radial direction of fan 38 and are tapered radially inward and toward ring 76. As shown in FIG. 9, this results in a substantially radial airflow at the high-pressure side of fan 38. The flatness and taper of blades 78 helps to achieve axial equilibrium, thereby allowing blades 78 to be fully packed with air along the spin axis, which optimizes total airflow. In other words, the taper aids in providing a substantially uniform output air pressure that is substantially uniform across the depth (between rings 74 and 76) of fan 38. This results in an even or uniform and substantially turbulence free airflow throughout fan chamber 30, thereby providing a substantially uniform pressure at all of the ingress ports 64 about the periphery of divider wall 42. The uniform air pressure and ingress port shape and smoothness provides a substantially straight and substantially turbulence free airflow entering oven chamber 28 along its side walls, top wall and bottom wall.

An added benefit to fan 38 is that debris from oven chamber 28 will not be trapped as sometimes happens with curved blades 72 of prior art fan 64.

Figure 11:
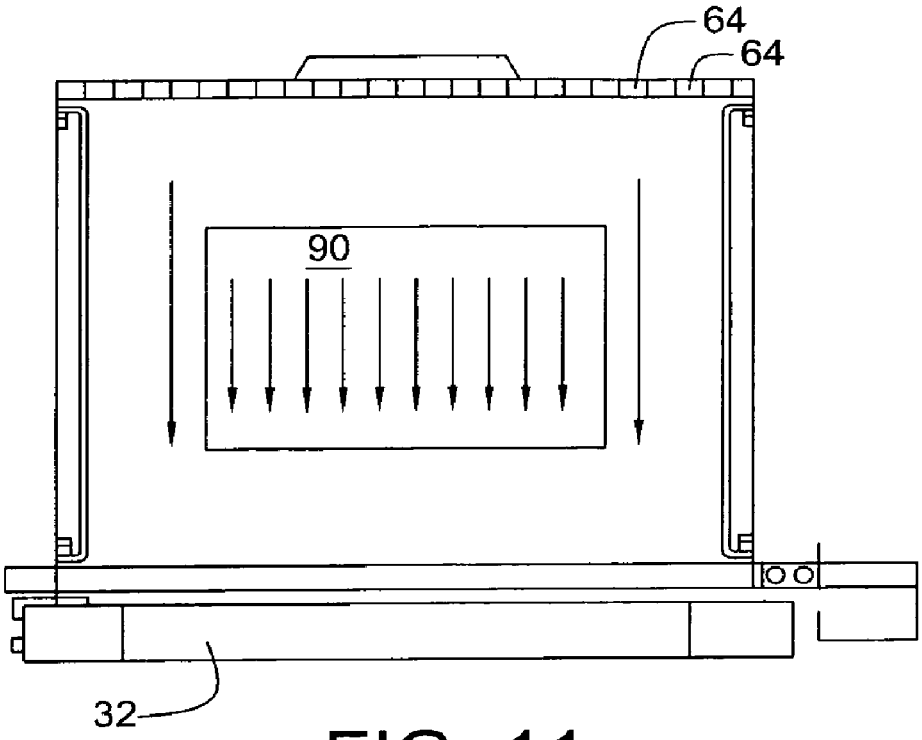
FIG. 11 is another cross-sectional view similar to FIG. 3.
Figure 12:
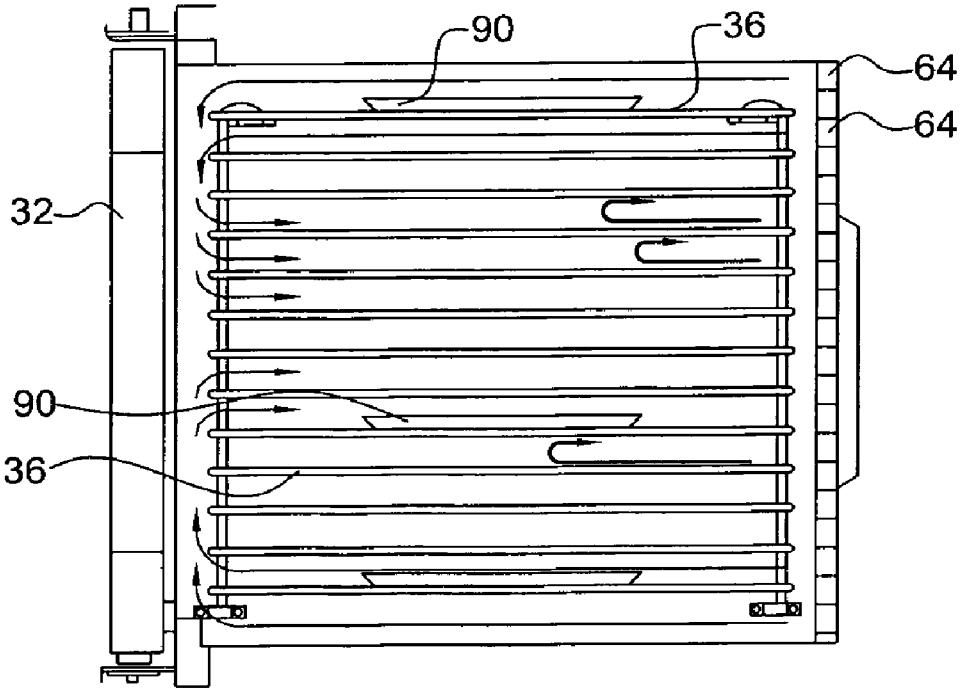
FIG. 12 is another cross-sectional view similar to FIG. 2.

Referring to FIGS. 11 and 12, the airflow straightness along the top wall of oven chamber 28 is shown by the arrows in FIG. 11 and along a side wall in FIG. 12. FIG. 12 also shows a laminar and vectored airflow that occurs when racks 36 are loaded with one or more pans 90. That is, the straight airflow from ingress ports 64 travels from ingress ports 64 toward front doors 32 and then interleaves with pans 90 as the low pressure at egress port 44 becomes the dominant force. Thus, the airflow entering oven chamber 28 along the top of divider wall 42 is over pan 90 on an upper one of racks 36 toward doors 32 and returns toward the center of oven chamber 28 under the same pan 90 or a lower pan 90 when low pressure at egress port 44 dominates. The airflow entering oven chamber 28 along the sides of divider wall 42 is toward doors 32 and turns inward above and below pans 90 as it returns toward and along the center of oven chamber 28 under the influence of low pressure at egress port 44. The laminar airflow in oven chamber 28 has considerably less turbulence than is provided by prior art fan 64 and prior art divider wall and ingress port designs.

Figure 13:
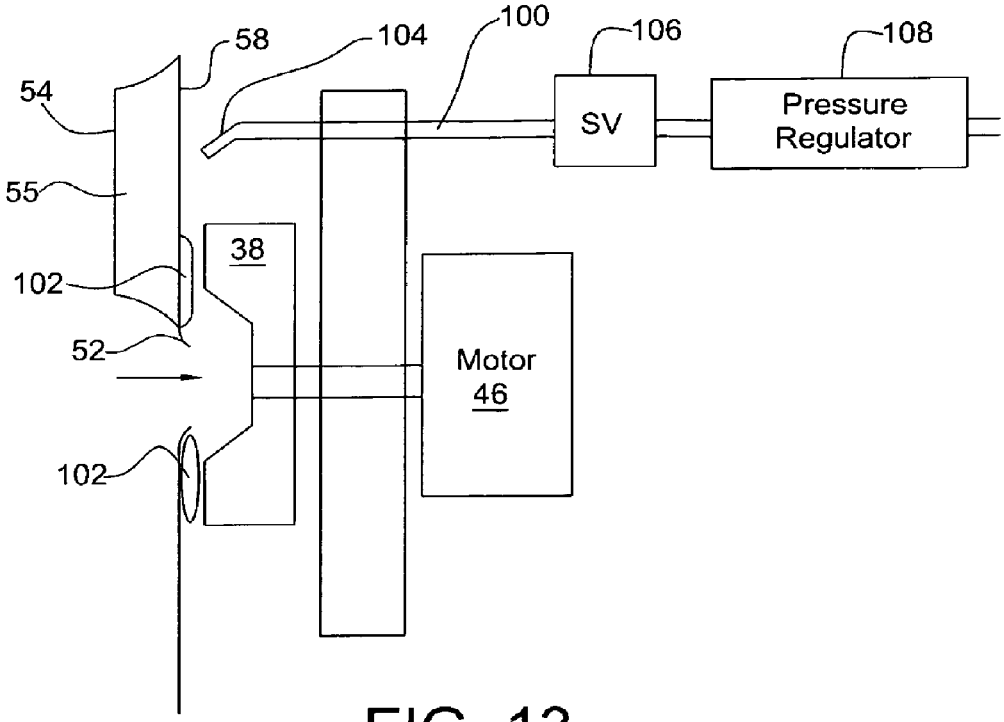
FIG. 13 is a detail view of detail 13 of FIG. 2.

Referring to FIGS. 2 and 13, another embodiment of the present invention injects moisture into the heated airflow. To this end, a moisture delivery device shown as a moisture delivery tube 100 is located to inject water against surface 58 of divider wall 42 at an angle to reduce splashing. For example, moisture delivery tube 100 has a bend or curve 104 to assure that the water strikes surface 58 at an angle. Alternatively, moisture delivery tube 100 could be oriented at an angle to surface 58 of divider wall 42.

The water is carried around inlet ring 52 as an annular shaped sheet 102 of water on surface 58 of divider wall 42 by the air current generated by fan 38. By keeping the water in an annular sheet on surface 58 of divider wall 42, the water is converted to steam by the hot surface 58, while reducing the amount of droplets in the convection airflow. The steam is mixed with the return airflow at the suction input and slightly upstream of fan 38. The portion of divider wall 42 forming void 55 is heated by the combustion products by conduction by convection of the heated airflow and functions as a hot plate for producing steam as the water is flashed thereon.

Moisture tube 100 is connected in line with a conventional water supply (not shown) via a solenoid valve 106 and a pressure regulator 108. Solenoid valve 106 turns the flow of water to moisture tube 100 on and off. Pressure regulator 108 controls the water pressure and, hence, the water flow rate in moisture tube 100.

Thus, water is introduced in a regulated manner into the intake or low pressure side of fan 38. This imparts moisture to the heated airflow so as to enable convection oven 20 to handle a wide variety of products. Moisture is imparted to the radially exiting air on the high pressure side of fan 38. The moisture laden air enters oven chamber 28 via ingress ports 62 of divider wall 42. The moisture laden airflow enhances the thermal transfer rate by about 300% vis-à-vis the thermal transfer by dry air.

Figure 14:
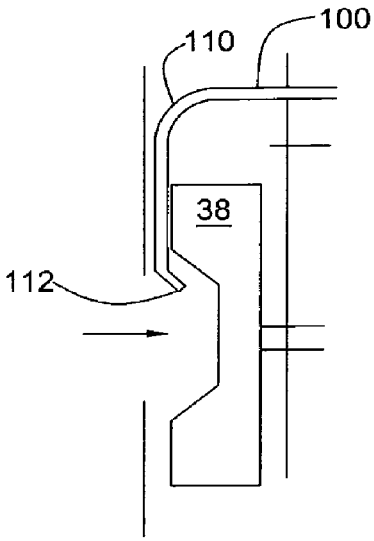
FIGS. 14 and 15 are views of alternate embodiments of the detail of FIG. 13.

Referring to FIG. 14, in an alternate embodiment, moisture tube 100 has a bend 110 that locates a tip 112 thereof within or at the entrance of fan 38 so that water is injected into the return or suction airflow. Upon contact with the hot blades 78 and/or the hot support structure 82 (heated by the hot airflow) thereof, the water is converted to steam, thereby imparting moisture to the heated airflow.

Figure 15:
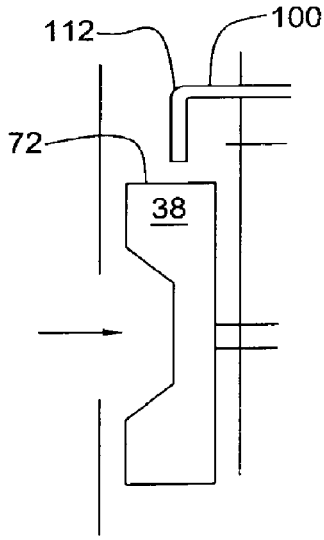

Referring to FIG. 15, in another alternate embodiment, water is introduced in a regulated manner against fan blades 72 on the high pressure side of fan 38. The water upon contact with hot blades 72 is converted to steam so as to impart moisture into the heated airflow.

Preferably, the moisture to be added is taken from a water supply so as to eliminate the need for costly and bulky team generators. However, the embodiments of FIGS. 13-15 could alternatively use steam if desired.

The moisture injection feature of the embodiments of the present invention shown in FIGS. 14 and 15 uses the hot surface of the fan wheel to create steam from direct water injection without a boiler.

Convection oven 20 of the present invention moves hot air around in the oven chamber very evenly so that turning a food product for baking is unnecessary. Fan 38 can be operated at two different speeds. When set at a high speed, the air moves at high velocities allowing faster cooking. Searing, crisping and fried like textures may be accomplished using the high speed air velocity in combination with intense temperatures. The lower speed is better for soft batters to avoid "drifting" of batters. Combining moisture with the mechanically assisted air movement inside the oven chamber carries more energy to the food surface. Browning takes place faster and more evenly in the presence of moisture. Appearance of the finished food product is influenced significantly by the moisture.

Convection oven 20 may be cleaned by providing an integral hose (not shown) that allows for an easy clean operation. Convection oven 20 may also be provided with a recessed bottom "shower stall" (not shown) to contain the liquids when washing down the inside of the oven. The residue drains out the back of convection oven 20.

Convection oven 20 of the present invention improves the finished food product in texture, appearance, yield, moisture and holding quality. Texture and appearance of bread products is especially far superior when moisture is added. The yield is better. There is less weight loss due to evaporation when moisture is in the unit. The food product is more moist, especially, chicken and other protein products. The holding quality is also superior. There is also a significant improvement in baked products, such as cakes and hard rolls, in texture and color with moisture versus without moisture, everything else being the same. For example, hard rolls baked with moisture have a much better color and far crisper surface than those baked without moisture.

Although convection oven has been described as employing a gas heater it will be apparent to those skilled in the art that electrical heaters could alternatively be used.

The present invention having been thus described with particular reference to the preferred forms thereof, it will be obvious that various changes and modifications may be made therein without departing from the spirit and scope of the present invention as defined in the appended claims.

What is claimed is:

1. A method of providing steam to a heated airflow that circulates through an oven chamber and a fan chamber of a convection oven, said method comprising:

providing said steam by flashing water on a heated surface on a wall between said fan chamber and said oven chamber at a low pressure input side of a fan that provides said circulating airflow and that is disposed in said fan chamber; and mixing said steam with said circulating airflow at said low pressure input of said fan before the mixed airflow exits via a high pressure side of said fan.

2. The method of claim 1, wherein said water is flashed at an angle to said heated surface such that splashing is reduced.

3. The method of claim 1, wherein said heated surface functions as a hot plate for producing said steam.

4. The method of claim 1, wherein said mixing step further mixes heat with said airflow at said low pressure input side of said fan.

5. The method of claim 1, wherein said heated surface faces said low pressure input side of said fan.

6. A method of providing steam to a heated airflow that circulates through an oven chamber and a fan chamber of a convection oven, said method comprising:

providing said steam by flashing water on a heated surface on a wall between said fan chamber and said oven chamber at a low pressure input of a fan that provides said circulating airflow and that is disposed in said fan chamber; and mixing said steam with said circulating airflow at said low pressure input of said fan, wherein said water is formed as an annular sheet on said heated surface.

* * * * *